United States Patent [19]

Hettich

[11] 4,455,858

[45] Jun. 26, 1984

[54] METHOD OF MANUFACTURING A HOLLOW NEEDLE FOR TAG FASTENERS

[75] Inventor: Heinz W. Hettich, Furtwangen, Fed. Rep. of Germany

[73] Assignee: Firma Heinz Hettich, Fed. Rep. of Germany

[21] Appl. No.: 270,918

[22] Filed: Jun. 5, 1981

[30] Foreign Application Priority Data

Nov. 6, 1980 [DE] Fed. Rep. of Germany ..... 3021799

[51] Int. Cl.[3] ..... B21D 53/00; B21G 1/08

[52] U.S. Cl. ..... 72/324; 163/5; 66/116; 407/34

[58] Field of Search ..... 72/324; 76/101 R; 163/5, 1; 66/116; 112/222; 223/102; 407/34, 40, 42, 53, 54, 61, 62, 63

[56] References Cited

U.S. PATENT DOCUMENTS

| | | | |
|---|---|---|---|
| 1,343,396 | 6/1920 | Kopf | 409/40 |
| 2,010,624 | 8/1935 | Clauss | 76/101 R |
| 2,056,201 | 10/1936 | Miller | 163/5 |
| 2,069,878 | 2/1937 | Flood | 227/67 |
| 2,358,304 | 9/1944 | Cogsdill | 72/324 |
| 3,800,386 | 4/1974 | Bishop | 72/402 |

FOREIGN PATENT DOCUMENTS 1805474 1/1978 Fed. Rep. of Germany .

*Primary Examiner*—Daniel C. Crane
*Attorney, Agent, or Firm*—McGlew and Tuttle

[57] ABSTRACT

A method of manufacturing hollow needles from round metal blanks in order to form a needle which has an inner front portion with a front end tapering to a point and a rear portion having a larger diameter than the front portion and forming a mounting shank, comprising forming a longitudinally extending needle guide to the needle such that the guide is open at the rear end of the mounting shank and tapers from a substantially uniform depth along a major portion of its length to a minimum depth adjacent the tip. The channel is of a shape to receive substantially cylindrical cross pins having an appended piece of filament which form a part of fasteners for tags, buttons and similar items to be attached to carrier materials such as textiles. The method is carried out by the use of a disc-shaped miller cutter which has U-shaped convex teeth for milling the central area of the channel in side tooth portions for milling shoulders on each side of the channel which are of lesser depth than the channel. The side tooth portions are employed to mill inclined V-recessed surfaces on each side of the central channel. In accordance with the inventive method after the channel is milled it goes to extend from the rear end along the inner front portion and taper to substantially a minimum depth at a spaced location from the tip, a stamping tool is used to engage into the inclined surfaces formed by the side teeth so that these surfaces are pressed inwardly to close a major portion of the length of the channel but without closing a release portion adjacent the tip of the needle which is less substantially equal to the width of the channel.

5 Claims, 10 Drawing Figures

Fig. 2
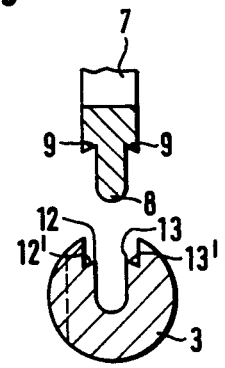
Fig. 3
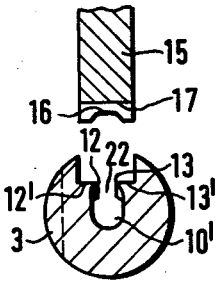
Fig. 1
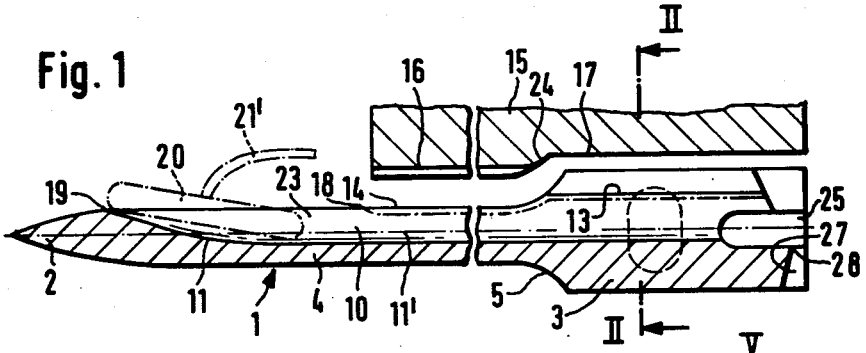
Fig. 4
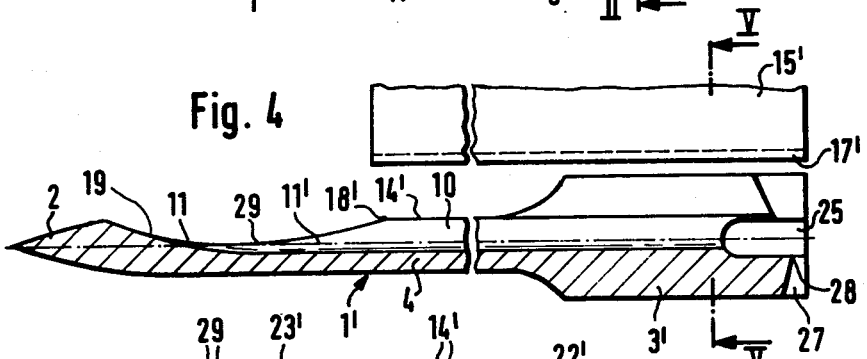
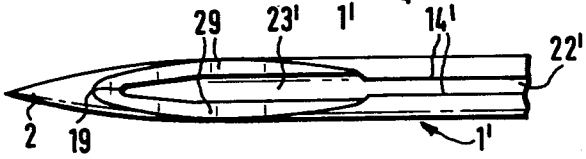
Fig. 4a Fig. 7
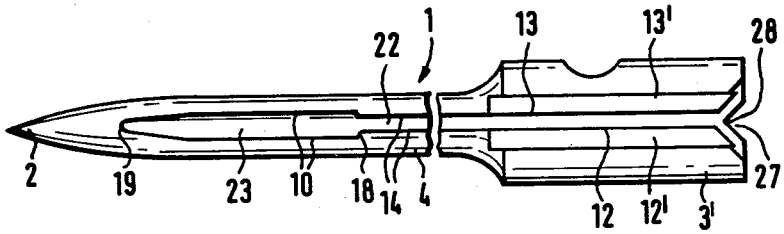
Fig. 8
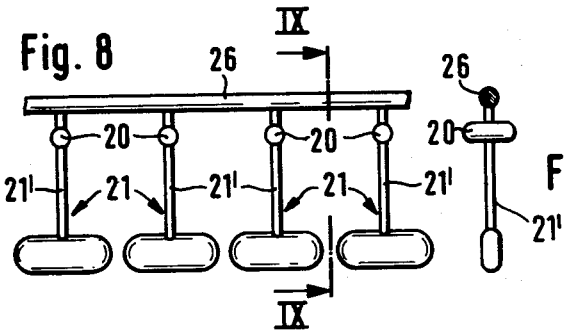
Fig. 9
Fig. 5
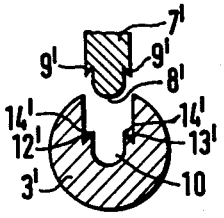
Fig. 6
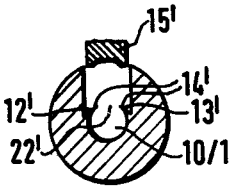

METHOD OF MANUFACTURING A HOLLOW NEEDLE FOR TAG FASTENERS

FIELD AND BACKGROUND OF THE INVENTION

This invention relates in general to sewing devices and in particular to a new and useful method of manufacturing a hollow needle from a round metal blank to form needles of a kind which is particularly applicable for associating fasteners for tags, buttons and similar items to textile materials or other carriers.

Hollow needles of this kind are employed in devices for attaching buttons, tags, fasteners, etc., to textile materials or similar carriers, which fasteners are made of plastic and serially and detachably fixed to a string. They comprise each a head portion, a piece of filament extending transversely therefrom, and a cross pin provided in the middle or at the end of the filament. The hollow needle serves the purpose of piercing the carrier to which the fastener is to be attached and of passing the cross pin therethrough. To this end, the device is equipped with a piston which is movable in reciprocating motion in the guide channel of the needle, transversely to a feed channel through which the cross pin of the fastener is introduced into the needle to be pushed therethrough.

While manufacturing such hollow needles from round steel in accordance with the prior art, the guide channel is produced by drilling a concentric bore from the front side into the blank rough-turned with a needle point and a mounting shank, which bore extends about to the location where the needle point portion starts to taper. This requires a center bore in advance, in the front face of the mounting shank. Then, the release slot of the bore is milled adjacent the needle point bore end, by means of a disc-shaped cutter having a width exceeding the outer diameter of the needle and introduced radially to a proper depth to produce a recess in the shape of a circular sector, whereupon, by means of another milling cutter having a smaller diameter and a width corresponding to the diameter of the bore, the arcuate, shallowing-out end portion of the bore is milled. Thereafter, with still another disc-shaped milling cutter narrower than the bore diameter, the longitudinal slot within the bore is milled in a further operation.

Even while disregarding the subsequently necessary operation of trimming, five machining operations are thus needed for producing the guide channel alone, with prior art methods.

It is further known to manufacture hollow needles for such tag attaching devices from oblong pieces of flat stock having lateral front end portions for forming the needle point, by bending the blank to a tubular element for guiding the cross pins, in which the longitudinal edges form the longitudinal slot and the projecting lateral rear portions left straight are used for fixing the hollow needle in a housing. The mounting shank at the rear of the needle is then formed by a pointed piece of plastic. The manufacture of such hollow needles formed by bending to a tube is inexpensive indeed, however, they have the disadvantage of an unsatisfactory stability, particularly in the needle point zone, so that they may easily deform or, with hard materials to be pierced, the point may break off or soon become dull (see German AS No. Lb 18 05 474). For this reason, in practice, hollow needles machined from round steel are preferred in the manufacture of tag attaching devices (in this connection see U.S. Pat. No. 2,069,878).

SUMMARY OF THE INVENTION

The invention is directed to a method for manufacturing hollow needles from round steel, making it possible to produce the axial guide channel of the needle in a particularly simple way requiring less operations.

Accordingly with the method of the invention the milling cutter is engaged with the round metal blank so that the central tooth thereof forms a channel extending from the rear end to a major portion of the inner front end and tapers toward the point to a shallow depth wherein side teeth portions of the miller form oblique surfaces on each side of the channel. Thereafter the side surfaces are engaged by a stamping tool which closes off a portion of the top opening of the channel along a portion of its length which extends from the rear portion through a portion of the inner front portion leaving a part of the channel open adjacent the point of the needle for release of the cylindrical cross pins of the attachment tags.

The invention eliminates not only the drilling operation which frequently leads to an off-center run of the drill or breakage thereof, particularly with small-diameter drills, but also an additional milling of the release slot of the guide channel at the needle point and the radial relief milling therefor, and the provision of a center bore in the front of the mounting shank. In addition, the inventive method avoids the inevitable circular ridges from drilling in the guide channel which may considerably hinder the passage of the cross pins of the fastener to be attached.

It has been found expedient to have the miller teeth shaped so that shoulder portions are formed on each side of the channel in the form of V-shaped recesses. This ensures that the stamping of the shoulder portion is easier and will be more uniform and ensures a larger radial extension of the guide channel in the mounting shank portion as compared to the needle zone. This is of advantage particularly if the pieces of filament which are molded integrally with the cross pins are somewhat thicker in the vicinity of the pins than in their remoter portions and thus the arrangement facilitates the introduction of the fastener into the hollow needle and its shifting therethrough.

Accordingly it is an object of the invention to provide a method of manufacturing a hollow needle from a round metal blank in order to form a needle having an inner front portion with a front end tapering to a point and a rear portion which has a larger diameter than the front portion and forms a mounting shank and wherein the needle has a longitudinal guide channel defined therein which is open at the rear end and tapers from a substantially uniform depth along a major portion of its length along the rear end portion and the inner front portion up to the minimum depth at a space location from the tip and wherein the channel is adapted to receive substantially cylindrical cross pins with an appended piece of filament which form a part of the fasteners for tags, buttons and similar items be attached to carrier material such as textiles and using a disc-shaped miller cutter having a U-shaped convex tooth with a side tooth portion on each side of the cutting tooth and also using a stamping tool which comprises cutting a channel into the needle blank with the miller cutter and with shoulder portions on each side of the channel thereafter engaging the shoulder portion with the stamping tool to close a portion of the channel leaving a radially open release slot adjacent the needle point portion having a width substantially equal to that of the channel.

A further object of the invention is to provide a method of manufacturing a hollow needle from a round blank which is simple in concept and execution and inexpensive to carry out. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is an axial sectional view of a hollow needle and partly of a stamping tool;

FIG. 2 is a section taken along the line II—II of FIG. 1, and a corresponding section of the milling cutter portion;

FIG. 3 is a similar view showing the result of the stamping operation, and a portion of the stamping tool;

FIG. 4 is a view similar to FIG. 1, showing another embodiment;

FIG. 4*a* is a partial top view corresponding to FIG. 4 and showing the needle point portion;

FIG. 5 is a sectional view taken along the line V—V of FIG. 4;

FIG. 6 is a similar view showing the result of the stamping operation;

FIG. 7 is a top view of the finished hollow needle of FIG. 1;

FIG. 8 shows a string of tag fasteners in an elevational view;

and

FIG. 9 is a side view from section IX—IX of FIG. 8.

DESCRIPTION OF THE PREFERRED EMBODIMENTS

Referring to the drawings, in particular the invention embodied therein comprises a method of manufacturing a hollow needle generally designated 1 from a metal blank in order to form a needle having an inner front end portion 4 with a front end tapering to a point 2, a rear portion 3 having a larger diameter than the front portion and opening at that end. In accordance with the invention a longitudinally extending guide channel is defined in the needle and that it is opened at the end of the rear portion 3 and tapers from a substantially uniform depth along a major portion of its length to a minimum depth adjacent the tip 2. The channel or groove 10 thus formed is adapted to receive a substantially cylindrical cross pin 20 shown in FIGS. 8 and 9 which has an appended piece of filament 21' and which forms a part of a fastener for tags, buttons and similar items to be attached to carrier materials such as textiles (not shown). The inventive method is carried out with the use of disc-shape miller cutter 7 having U-shaped convex teeth 8 with side teeth portions 9, 9 on each side of the tooth 8. Also employed is a stamping tool 15. After the channel is cut with the miller cutter and a shoulder on each side of the channel is formed in the blank with the cutter, the stamping tool is employed to engage the shoulders formed by the side teeth and press them inwardly to close a portion of the channel along its length but leaving a portion adjacent the point open to the same width as the channel in order to provide a release slot for the cross pins 20.

The hollow needle 1 shown in FIG. 1 is substantially a single-piece round steel part turned to have a tapering point portion 2 on its front end and a mounting shank 3 on its rear end, with the mounting shank having a double diameter relative to the thinner front portion 4 of the needle. A rounded-corner transition 5 is formed between thinner needle portion 4 and mounting shank 5. An axially extending guide channel 10' is produced by first using a disc-shaped milling cutter 7 having a U-shaped convex teeth 8 with V-shape side teeth 9 projecting from either side. A longitudinal groove 10 is milled from the rear end of the mounting shank 3, which terminates near the needle point 2 in a radially curved, shallowing-out portion 11 corresponding to the circumferential curvature of the milling cutter 7. While milling longitudinal groove 10, cutter 7 penetrates with its convex tooth portion 8 into the needle material to such a depth that the center of the semicircular convex portion of the teeth 8 coincides with the longitudinal axis 11 of needle 1. This produces the cross section of longitudinal groove 10 as shown in FIG. 2 and, within the extension of mounting shank 3 having a larger diameter, shoulders 12,13 are produced in addition which are formed by inclined V-recess surfaces 12', 13' which extend outside the diameter of the needle thinner inner front portion 4 and thus radially upwardly of groove edges 14 of portion 4. That is, in this embodiment, the radial spacing of side teeth 9 of cutter 7 from the center of the convex tooth 8 exceeds the radius of the thinner needle inner front portion 4.

By means of a stamping tooth 15 having a width approximately equal to the cutting width determined by side teeth 9 of cutter 7, and offset stamping face portions 16 and 17, shoulders 12, 13 and 14 of longitudinal groove 10 are pressed inwardly so that a guide channel 10' is formed having the shape shown in FIG. 3, namely the shape of an elongated slotted hole within the extent of mounting shank 3, and substantially the shape of a bore, slit in the axial direction. The axial extension of stamping face portion 16 is limited, so that shoulders 14 of thinner needle portion 4 are not pressed in along their entire length but only from transition zone 5 to a location 18, and a release slot 23 is thus left between location 18 and the end point 19 of groove 10, through which the cross pins 20 of tag fasteners 21 (shown in FIG. 8), after being pushed from the shank end through channel 10' can be radially released from the needle. In this way, the width of longitudinal groove 10 as cut by cutter 7 in the blank between locations 18 and 19 is preserved, while in the rearward portion of needle 1, the axially extending slot 10', identical with the lower portion of groove 10, is partly closed by pressing shoulders 12, 13, 14 together to a slit 22 which is narrower than guide channel proper 10'. With the needle in use, axial slit 22 permits the filament 21' of the tag fastener to slide therethrough as cross pin 20 is pushed through guide channel 10'.

It is advisable to trim the edges or shoulders 14 or chamfer them with a file, for example, within the extent of release slot 23. To avoid a radially stepped shoulder in the transition zone 5, which would be formed by pressing shoulders 12, 13, 14 inwardly, the corresponding transition portion 24 between stamping faces 17 and 16 of stamping tool 15 is rounded or slanted. The oval or oblong cross section of guide channel 10' in the zone of mounting shank 3 facilitates the introduction of cross pins 20 into the rear portion of guide channel 10', particularly in instances, which are frequent in practice, where the filament 21' of tag fastener 21 is somewhat thicker at its junction with cross pin 20 than elsewhere. A transverse groove 25 is provided at the rear end of mounting shank 3 of needle 1, through which cross pins 20 are introduced into guide channel 10'. In addition, a notch 27 with a cutting edge 28 is milled into the rear end of guide channel 10', to be able to cut cross pins 20 off filament portions 21' by which they are connected to a string 26.

In the embodiment shown in FIGS. 4, 4*a*, 5 and 6, the manufacturer starts from the same needle blank as in the first embodiment. However, a modified form miller cutter 7' is employed for cutting longitudinal groove 10, having its V-shaped side teeth 9' spaced less from the periphery of the U-shaped convex tooth 8' which is conformable to the radius of the thinner needle portion 4. With the use of this cutter 7', shoulder edges 14' extend in a common plane throughout, i.e., both in the zone of mounting shank 3 and in the zone of thinner needle portion 4. Therefore, a stamping tool 15' having a throughout even, not offset, stamping face 17' is employed for pressing shoulders 14' of longitudinal groove 10 inwardly. Consequently, longitudinal groove 10 cut with cutter 7' is given the cross-sectional shape shown in FIG. 5, with the V-shape recesses 12', 13' at shoulder edges 14' extending along the mounting shank portion 3' and the inner front portion H. The stamping of shoulders 14' by tool 15' thus results in a formation of an at least substantially round guide channel 10/1 having the same cross section along its length and a longitudinal slit 22'.

As with the embodiment of FIG. 2, the V-shaped teeth have walls extending at an acute angle so that the resulting shoulders have walls extending at an acute angle with internal surfaces lying parallel to the depth of the longitudinal groove 10 and inclined V-recess surfaces 12', 13', inclined outwardly from the groove.

Another different over needle 1, i.e., the first embodiment, is that hollow needle 1' is made with a radially arcuate, milled-out recess 29 extending from a location 18', corresponding to location 18 of the first embodiment, to the terminal point 19 of longitudinal groove 10, so that guide channel 10/1 opens at 18' into a radial release opening 23' extending up to end 19 of groove 10. This milled-out recess 29 somewhat facilitates the removal or release of cross pin 20 of the tag fasteners from the guide channel. This recess 29 however, is not absolutely necessary. Even without recess 29, the hollow needle can be manufactured with greater economy, since one machine operation is eliminated. Otherwise, the manufacturing costs of hollow needle 1' are identical with those of needle 1, except that a stamping tool 15 is slightly more expensive than a stamping tool 15' having a throughgoing even stamping face 17'. In any event, the inventive method makes it possible to manufacture hollow needles 1 and 1' both in a substantially less expensive way and in a quality exceeding that achieved in prior art methods where first a center bore, then a slot and finally the release opening must be produced in separate operations.

While specific embodiments of the invention have been shown and described in detail to illustrate the application of the principles of the invention, it will be understood that the invention may be embodied otherwise without departing from such principles.

What is claimed is:

1. A method of manufacturing a hollow needle from a round metal blank to form a needle having an inner front portion with a front end tapering to a point and a rear portion having a larger diameter than the front portion and forming a mounting shank, the needle having a longitudinal guide channel defined therein which is opened at the rear end of the rear mounting shank and tapers from a substantially uniform depth along a major portion of its length to a minimum depth adjacent the point, the channel being adapted to receive substantially cylindrical cross pins with an appended piece of filament which forms a part of a fastener for tags, buttons and simular items to be attached to carrier material such as textiles, comprising:

forming in a single operation the channel to a depth of substantially half the diameter of the round metal blank using one miller cutter, said single operation also forming a shoulder portion on each side of the channel at least in the rear mounting shank which has an interior surface extending in the channel and an inclined surface extending outwardly of the top of the channel using the same miller cutter which miller cutter has a U-shape convex tooth and a side tooth portion on each side of the convex tooth and is shaped so that each side tooth portion is positioned with respect to the convex tooth for forming each shoulder portion with its inclined surface extending outside a diameter of the front portion of the needle; and after forming the channel, pressing the shoulder portions using a stamping tool to inwardly close a portion of the top of the channel, the stamping tool shaped to have a pair of stamping faces with a transition zone therebetween adapted to engage the metal blank over a transition zone between the front portion and the mounting shank thereof, the stamping face of the stamping tool for engaging the shoulder portions in the mounting shank being offset in a direction away from the mounting shank with respect to the stamping face for engaging the front portion, thereby forming the channel in the rear mounting shank to have an oblong cross section with respect to the channel in the front portion.

2. A method according to claim 1 wherein along the mounting shank area of the needle the shoulder portions which are formed by the miller cutter are cut to form substantially a V-shaped recess.

3. A method according to claim 1, wherein the miller cutter side teeth are shaped and employed so as to form shoulder portions on each side of the channel which includes portions in the mounting shank length which are greater than the portions along the front end of said needle.

4. A method according to claim 1, including forming a curved recess in the front portion over the release portion of the channel.

5. A method according to claim 1, wherein the stamp is shaped to leave a release portion of the channel adjacent the point unpressed for the release of the pin by leaving the channel at a substantially uniform width adjacent the point.

* * * * *